US012618240B2

(12) United States Patent
Scott

(10) Patent No.: US 12,618,240 B2
(45) Date of Patent: May 5, 2026

(54) ROOF FAçADE ASSEMBLY AND SEALABLE BRACKET ASSEMBLY FOR MOUNTING THE SAME

(71) Applicant: KDScott Companies LLC, Rochester, NY (US)

(72) Inventor: Kevin Douglas Scott, Rochester, NY (US)

(73) Assignee: KDScott Companies LLC, Rochester, NY (US)

( * ) Notice: Subject to any disclaimer, the term of this patent is extended or adjusted under 35 U.S.C. 154(b) by 192 days.

(21) Appl. No.: 18/406,430

(22) Filed: Jan. 8, 2024

(65) Prior Publication Data

US 2024/0279931 A1 Aug. 22, 2024

Related U.S. Application Data

(60) Provisional application No. 63/485,571, filed on Feb. 17, 2023.

(51) Int. Cl.
*E04D 5/14* (2006.01)
*E04D 13/14* (2006.01)

(52) U.S. Cl.
CPC ..... *E04D 5/145* (2013.01); *E04D 5/142* (2013.01); *E04D 13/14* (2013.01); *E04D 2013/1422* (2013.01)

(58) Field of Classification Search
CPC ..... E04D 3/405; E04D 5/142; E04D 5/145; E04D 13/14; E04D 2013/1415; E04D 2013/1422
USPC ..... 52/408
See application file for complete search history.

(56) References Cited

U.S. PATENT DOCUMENTS 2,001,162 A * 5/1935 Strauss ..... E04B 1/215 99/421 V
2,339,220 A * 1/1944 Crowley ..... E04B 1/14 52/282.4
2,413,588 A * 12/1946 Smith ..... E04D 13/1415 52/60
2,857,861 A * 10/1958 Trostle ..... E04D 13/155 52/94
3,242,622 A * 3/1966 Snead ..... E04D 13/15 52/364
3,509,672 A * 5/1970 Brooks ..... E04B 2/96 52/235
3,533,201 A * 10/1970 Tyler ..... E04D 13/155 52/60
3,668,811 A * 6/1972 Pollard ..... E04D 13/15 52/60

(Continued)

FOREIGN PATENT DOCUMENTS

EP 1736608 A1 * 12/2006 ..... E04F 19/02
EP 3156554 B1 * 3/2020 ..... E04D 13/155

*Primary Examiner* — James M Ference
(74) *Attorney, Agent, or Firm* — Harter Secrest & Emery LLP; Michael Nicholas Vranjes

(57) ABSTRACT

A roof assembly, including a roof including a first top surface and an outer surface, a first membrane arranged on the first top surface, a base plate arranged on the first membrane and connected to the roof, a second membrane arranged on the base plate, and a bracket arranged on the second membrane and at least partially aligned with the base plate, wherein the bracket is secured to the base plate.

19 Claims, 7 Drawing Sheets

(56) References Cited

U.S. PATENT DOCUMENTS 3,680,269 A * 8/1972 Fischer, Jr. ..... E04D 13/155 52/60
3,719,010 A * 3/1973 Hickman ..... E04D 3/405 52/60
3,735,540 A * 5/1973 Thaler ..... E04D 13/155 52/96
3,738,068 A * 6/1973 Attaway ..... E04D 13/155 52/60
3,862,531 A * 1/1975 Attaway ..... E04D 3/405 52/58
3,952,471 A * 4/1976 Mooney ..... E04B 1/04 52/781.5
RE28,870 E * 6/1976 Attaway ..... E04D 3/405 52/58
4,083,158 A * 4/1978 Wolma ..... E04D 3/405 52/60
4,282,050 A * 8/1981 Thiis-Evensen ..... E04D 5/145 156/92
4,389,826 A * 6/1983 Kelly ..... E04D 5/145 52/410
4,483,112 A * 11/1984 Rueblinger ..... E04D 13/155 52/58
4,488,384 A * 12/1984 Hickman ..... E04D 13/155 52/60
4,531,332 A * 7/1985 Gartner ..... E04B 2/88 52/235
4,557,081 A * 12/1985 Kelly ..... E04D 13/17 52/406.3
4,598,507 A * 7/1986 Hickman ..... E04D 13/155 52/96
4,706,432 A * 11/1987 Fishburn ..... E04D 13/1415 277/921
4,858,406 A * 8/1989 Lane ..... E04F 19/02 52/58
4,932,171 A * 6/1990 Beattie ..... E04D 13/1415 52/273
4,964,248 A * 10/1990 Braine ..... E04D 3/405 52/60
4,977,720 A * 12/1990 Kuipers ..... B29C 66/21 52/410
5,031,367 A * 7/1991 Butzen ..... E04D 13/155 52/60
5,031,374 A * 7/1991 Batch ..... E04D 3/3603 52/460
5,189,853 A * 3/1993 Braine ..... E04D 13/15 52/60
5,384,994 A * 1/1995 Borba ..... F24S 40/10 52/261
5,388,379 A * 2/1995 Lamberti ..... E04D 13/15 52/468
5,558,470 A * 9/1996 Elmore ..... E02D 29/0283 405/262
5,608,993 A * 3/1997 Argiropoulos ..... E04D 3/405 52/96
5,740,647 A * 4/1998 Kelly ..... E04D 11/02 52/410
5,797,232 A * 8/1998 Larson ..... E04D 5/149 411/164
5,927,023 A * 7/1999 Kittilstad ..... E04D 13/155 52/716.2
6,526,701 B2 * 3/2003 Stearns ..... E04G 21/328 52/24
6,640,511 B1 * 11/2003 Link ..... E04D 5/147 52/410
6,845,590 B1 * 1/2005 Mills, Jr. ..... E04D 13/155 52/60
6,912,814 B1 * 7/2005 Inzeo ..... E04D 3/405 52/716.2
7,168,209 B2 * 1/2007 Heidler, Jr. ..... E04D 3/405 52/745.1
7,647,730 B1 * 1/2010 Inzeo ..... E04D 13/155 52/60
8,001,739 B1 * 8/2011 Inzeo ..... E04D 3/405 52/60
8,683,751 B2 * 4/2014 Stearns ..... E04D 13/10 52/173.1
8,782,983 B2 * 7/2014 Stearns ..... E04D 13/10 52/24
9,322,176 B2 * 4/2016 Kelly ..... E04D 5/00
9,493,943 B1 * 11/2016 Smith ..... E04B 1/665
9,587,403 B2 * 3/2017 Shevlin ..... E04D 13/00
10,214,910 B1 * 2/2019 Inzeo ..... E04D 13/155
10,858,847 B2 * 12/2020 Erickson ..... E04D 13/15
11,041,311 B1 * 6/2021 Duran ..... E04D 3/405
2001/0027625 A1 * 10/2001 Webb ..... E04F 19/02 52/60
2002/0083666 A1 * 7/2002 Webb ..... E04F 19/02 52/60
2002/0164447 A1 * 11/2002 Asgian ..... E04B 1/66 428/40.1
2002/0178671 A1 * 12/2002 Gembala ..... E04D 13/0459 52/302.6
2003/0051428 A1 * 3/2003 Kay ..... E04D 3/405 52/566
2004/0040243 A1 * 3/2004 Yaros ..... E04D 5/145 52/410
2006/0053703 A1 * 3/2006 Luttrell ..... E04D 13/15 52/94
2007/0261346 A1 * 11/2007 Kelly ..... E04G 21/00 52/408
2010/0307074 A1 * 12/2010 Stearns ..... H02S 20/23 52/173.1
2012/0023848 A1 * 2/2012 Stearns ..... E04B 1/66 52/302.6
2012/0233958 A1 * 9/2012 Stearns ..... H01Q 1/1221 52/708
2013/0009025 A1 * 1/2013 Stearns ..... G09F 7/18 248/237
2013/0081344 A1 * 4/2013 Argiropoulos ..... E04D 13/155 52/300
2015/0204067 A1 * 7/2015 Binder ..... E04B 1/348 52/204.2
2016/0010335 A1 * 1/2016 Kelly ..... E04D 13/1606 52/741.4
2016/0102458 A1 * 4/2016 Shevlin ..... E04D 13/00 52/741.4
2016/0305128 A1 * 10/2016 Shevlin ..... E04D 5/149
2016/0319548 A1 * 11/2016 Shevlin ..... E04D 13/00
2016/0376789 A1 * 12/2016 Shevlin ..... F24F 13/32 52/698
2017/0002567 A1 * 1/2017 Shevlin ..... F24S 25/613
2018/0266107 A1 * 9/2018 Martinez ..... E04C 2/521
2022/0403653 A1 * 12/2022 Dombowsky ..... E04C 2/2885
2024/0279931 A1 * 8/2024 Scott ..... E04D 5/145

* cited by examiner

ROOF FAçADE ASSEMBLY AND SEALABLE BRACKET ASSEMBLY FOR MOUNTING THE SAME

CROSS-REFERENCE TO RELATED APPLICATIONS

This application claims the benefit under 35 U.S.C. § 119(e) of U.S. Provisional Application No. 63/485,571, filed Feb. 17, 2023, which application is incorporated herein by reference in its entirety.

FIELD

The present disclosure relates to roofing systems, and more particularly, to a roof assembly that facilitates the mounting of a façade while maintaining a continuous fluid tight roof membrane seal.

BACKGROUND

Membrane roofing is a type of roofing system for buildings, recreational vehicles (RVs), ponds, and in some cases tanks. It is used to create a watertight covering to protect the interior of a building. Membrane roofs are most commonly made from synthetic rubber, thermoplastic, such as polyvinyl chloride (PVC) or similar material, or modified bitumen. Membrane roofs are most commonly used in commercial applications, though they are becoming increasingly common in residential application.

The requirements of current membrane roofing systems do not allow for a building façade, and as such hinder the aesthetic appearance of buildings in which the systems are installed.

SUMMARY

It is an object of the present disclosure to provide a roofing assembly that allows a façade to be mounted thereto without jeopardizing the sealable membrane system.

An exemplary embodiment of the present disclosure provides a roof assembly, including a roof including a first top surface and an outer surface, a first membrane arranged on the first top surface, a base plate arranged on the first membrane and connected to the roof, a second membrane arranged on the base plate, and a bracket arranged on the second membrane and at least partially aligned with the base plate, wherein the bracket is secured to the base plate.

In an exemplary embodiment, the roof further includes a parapet extending in a first direction from the roof proximate the outer surface, and the base plate is arranged on the parapet. In an exemplary embodiment, the base plate includes a second top surface, a bottom surface secured to the roof, and at least one protrusion extending from the second top surface. In an exemplary embodiment, the at least one protrusion extends through the second membrane. In an exemplary embodiment, the bracket includes a through-bore arranged to engage the at least one protrusion to secure the bracket to the base plate. In an exemplary embodiment, the second membrane is compressed between the bracket and the base plate. In an exemplary embodiment, the bracket includes at least one flange. In an exemplary embodiment, a panel is connected to the at least one flange, the panel arranged to at least partially cover the roof.

In an exemplary embodiment, the roof assembly further includes a wall connected to the roof and the parapet. In an exemplary embodiment, the roof assembly further includes a first panel connected to the wall, and a second panel connected to the bracket and arranged to at least partially cover the parapet. In an exemplary embodiment, the first panel extends elevationally above the parapet. In an exemplary embodiment, the second panel is arranged elevationally above and spaced apart from the roof. In an exemplary embodiment, the second panel is arranged at an acute angle with respect to the first panel. In an exemplary embodiment, the parapet includes a stepped top surface.

It is an object of the present disclosure to provide a roofing assembly that allows a façade to be mounted thereto without jeopardizing the sealable membrane system.

An exemplary embodiment of the present disclosure provides a roof assembly, including a roof including a first top surface and an outer surface, a parapet extending in a first direction from the roof proximate the outer surface, a first membrane covering the first top surface and the parapet, a base plate arranged on the first membrane and connected to the parapet, a bracket including at least one flange extending in the first direction, the bracket secured to the base plate, a second membrane arranged between the base plate and the bracket, and a first panel connected to the at least one flange and arranged to at least partially cover the parapet.

In an exemplary embodiment, the base plate includes a second top surface, a bottom surface secured to the parapet, and at least one protrusion extending from the second top surface in the first direction. In an exemplary embodiment, the at least one protrusion extends through the second membrane. In an exemplary embodiment, the bracket includes a through-bore arranged to engage the at least one protrusion to secure the bracket to the base plate. In an exemplary embodiment, the second membrane is compressed between the bracket and the base plate.

It is an object of the present disclosure to provide a sealable bracket assembly for a roof.

An exemplary embodiment of the present disclosure provides a scalable bracket assembly for a roof, including a base plate, including a first top surface, a first bottom surface, a first perimeter edge, and a protrusion extending from the first top surface, the protrusion being spaced apart from the first perimeter edge, a bracket, including a second top surface, a second bottom surface, a second perimeter edge, a through-bore arranged to engage the protrusion, and a flange extending from the second top surface, and a membrane secured between the first top surface and the second bottom surface, wherein the protrusion extends through the membrane.

An exemplary embodiment of the present disclosure provides a roof assembly, including a roof including a first top surface and a first outer surface, a parapet extending in a first direction from the roof proximate the outer surface, a base plate connected to the parapet, a membrane arranged on the top surface, the parapet, and the base plate, and a bracket arranged on the membrane and at least partially aligned with the base plate, wherein the bracket is secured to the base plate.

In an exemplary embodiment, the membrane seals the roof and the parapet. In an exemplary embodiment, the base plate includes a second top surface, a bottom surface secured to the parapet, and at least one protrusion extending from the second top surface. In an exemplary embodiment, the at least one protrusion extends through the membrane. In an exemplary embodiment, the bracket includes a through-bore arranged to engage the at least one protrusion to secure the bracket to the base plate. In an exemplary embodiment, the membrane is compressed between the bracket and the base plate. In an exemplary embodiment, the bracket includes at least one flange. In an exemplary embodiment, a panel is connected to the at least one flange, the panel arranged to at least partially cover the parapet.

In an exemplary embodiment, the roof assembly further includes a wall connected to the roof and the parapet. In an exemplary embodiment, the roof assembly further includes a first panel connected to the wall, and a second panel connected to the bracket and arranged to at least partially cover the parapet. In an exemplary embodiment, the first panel extends elevationally above the parapet. In an exemplary embodiment, the second panel is arranged elevationally above and spaced apart from the parapet. In an exemplary embodiment, the second panel is arranged at an acute angle with respect to the first panel. In an exemplary embodiment, the parapet includes a stepped top surface.

An exemplary embodiment of the present disclosure provides a roof assembly, including a roof including a first top surface and a first outer surface, a parapet extending in a first direction from the roof proximate the outer surface, a base plate connected to the parapet, a bracket including at least one flange extending in the first direction, the bracket secured to the base plate, a membrane covering the first top surface and the parapet, the membrane arranged between the base plate and the bracket, and a first panel connected to the at least one flange and arranged to at least partially cover the parapet.

In an exemplary embodiment, the base plate includes a second top surface, a bottom surface secured to the parapet, and at least one protrusion extending from the second top surface in the first direction. In an exemplary embodiment, the at least one protrusion extends through the membrane. In an exemplary embodiment, the bracket includes a through-bore arranged to engage the at least one protrusion to secure the bracket to the base plate. In an exemplary embodiment, the membrane is compressed between the bracket and the base plate.

These and other objects, features, and advantages of the present disclosure will become readily apparent upon a review of the following detailed description of the disclosure, in view of the drawings and appended claims.

BRIEF DESCRIPTION OF THE DRAWINGS

The accompanying drawings are incorporated herein as part of the specification. The drawings described herein illustrate embodiments of the presently disclosed subject matter and are illustrative of selected principles and teachings of the present disclosure, in which corresponding reference symbols indicate corresponding parts. However, the drawings do not illustrate all possible implementations of the presently disclosed subject matter and are not intended to limit the scope of the present disclosure in any way.

DETAILED DESCRIPTION

Figure 1:
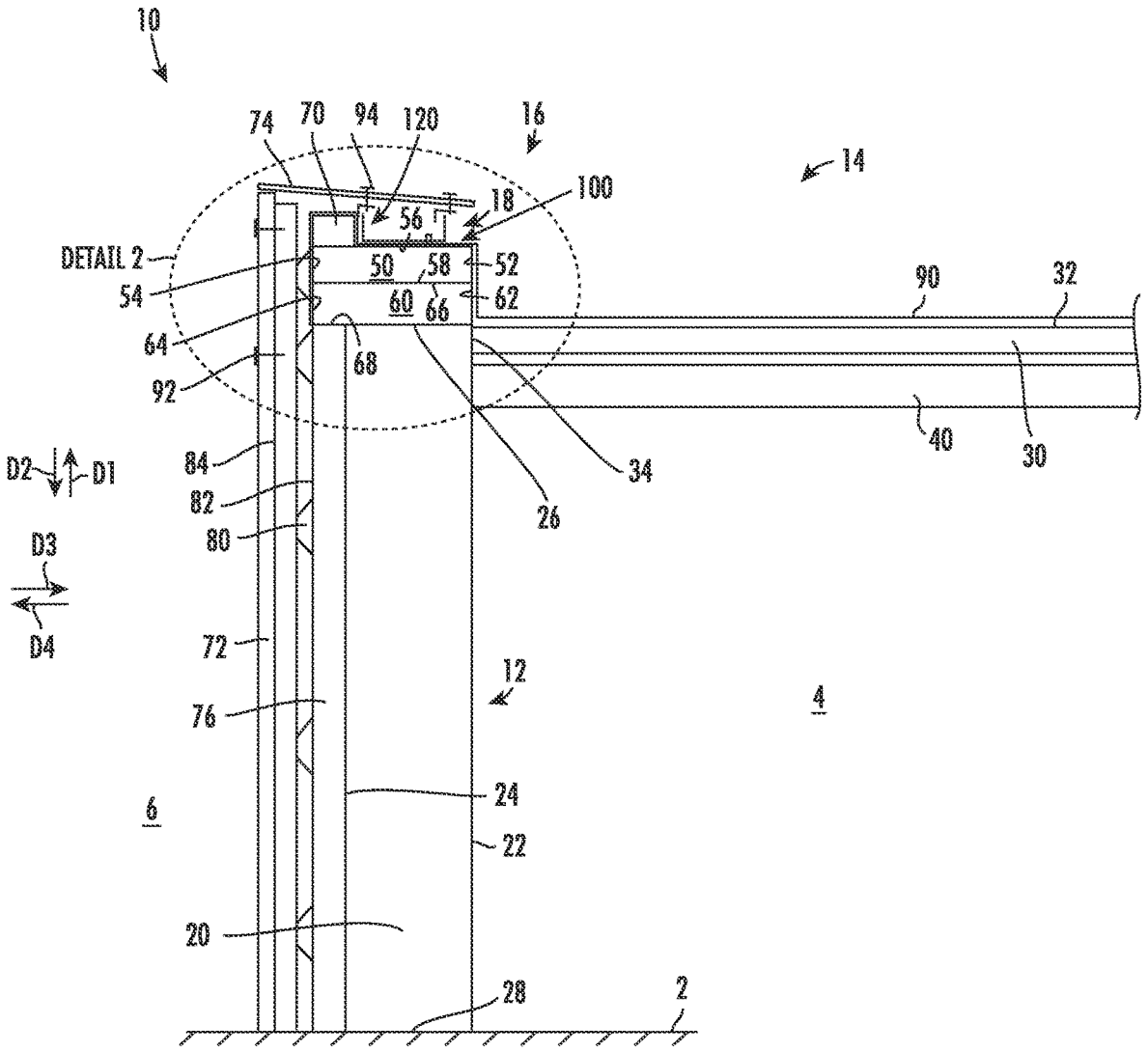
FIG. 1 is a cross-sectional view of a roof façade assembly.

It is to be understood that the invention may assume various alternative orientations and step sequences, except where expressly specified to the contrary. It is also to be understood that the specific assemblies and systems illustrated in the attached drawings and described in the following specification are simply exemplary embodiments of the inventive concepts defined herein. Hence, specific dimensions, directions, or other physical characteristics relating to the embodiments disclosed are not to be considered as limiting, unless expressly stated otherwise. Also, although they may not be, like elements in various embodiments described herein may be commonly referred to with like reference numerals within this section of the application.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

Where used herein, the terms "first," "second," and so on, do not necessarily denote any ordinal, sequential, or priority relation, but are simply used to more clearly distinguish one element or set of elements from another, unless specified otherwise.

Where used herein, the term "about" when applied to a value is intended to mean within the tolerance range of the equipment used to produce the value, or, in some examples, is intended to mean plus or minus 10%, or plus or minus 5%, or plus or minus 1%, unless otherwise expressly specified.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "substantially" is intended to mean values within ten percent of the specified value.

Where used herein, the term "exemplary" is intended to mean "an example of," "serving as an example," or "illustrative," and does not denote any preference or requirement with respect to a disclosed aspect or embodiment.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or a device comprising a second element and a third element.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or a device comprising a second element and a third element. A similar interpretation is intended when the phrase "used in at least one of:" is used herein.

"Blocking" or "block" as used herein is intended to mean one or more pieces of material for filling interstices, or for spacing, joining, or reinforcing members.

"Membrane" as used herein is intended to mean a material used to create a fluid tight and/or watertight covering to protect the interior of a building or other structure.

"Façade" as used herein is intended to mean an outward face of a building or structure that is maintained to conceal a less pleasant aesthetic appearance. Façade as used herein includes panels such as wall panels, roof panels, perforated panels, screening, or the like intended to create an aesthetically pleasing appearance of a building or structure.

Figure 2:
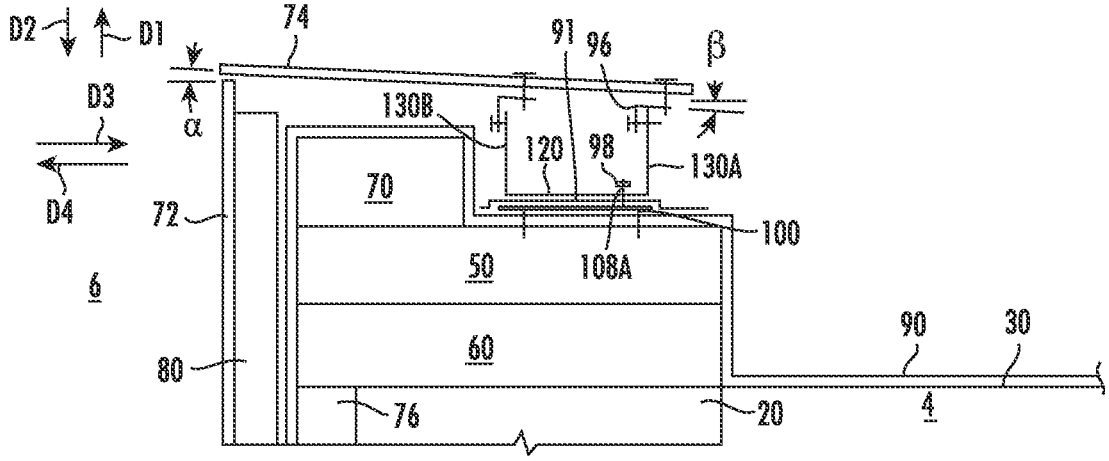
FIG. 2 is a detail view of the roof façade assembly taken generally along Detail 2 in FIG. 1.

Adverting now to the figures, FIG. 1 is a cross-sectional view of roof façade assembly 10. FIG. 2 is a detail view of roof façade assembly 10 taken generally along Detail 2 in FIG. 1. Roof façade assembly 10 generally comprises structure or building wall 12, structure or building roof 14, parapet 16, scalable bracket assembly 18, one or more panels or roof panels or wall panels or façades, for example panel 72 and panel 74, and membrane 90.

Wall 12 is an exterior wall of a building or structure separating building interior 4 and building exterior 6. Wall 12 may extend from ground 2 to roof 14. It should be appreciated that FIG. 1 shows only a partial cross-sectional view of a building or structure, it being understood that a building would have one or more walls 12 on which roof 14 is arranged. Wall 12 may comprise one or more layers according to desired structural and heat transfer properties. In an exemplary embodiment, wall 12 comprises stud wall 20.

Stud wall 20 is a vertical repetitive framing member that may support a load, for example, roof 14 and parapet 16. Stud wall 20 comprises inner surface 22, which faces substantially in direction D3 toward interior 4, outer surface 24, which faces substantially in direction D4 toward exterior 6, top surface 26, which faces substantially in direction D1, and bottom surface, which faces substantially in direction D2. In an exemplary embodiment, stud wall 20 extends from and/or is connected to ground or base 2. In an exemplary embodiment, stud wall 20 comprises wood. In an exemplary embodiment, stud wall 20 comprises metal. In an exemplary embodiment, stud wall 20 comprises concrete, for example, concrete masonry unit (CMU) blocks, pour concrete, or precast concrete.

In an exemplary embodiment, wall 12 further comprises insulation 76. Insulation 76 is arranged outside of stud wall 20 and may comprise any material that reduces the flow of thermal energy. For example, insulation 76 may comprise batt insulation. In an exemplary embodiment, insulation 76 may comprise cellulose insulation, two part closed cell spray foam insulation, open cell spray foam insulation, rigid foam board insulation, or fiberglass insulation. In an exemplary embodiment, insulation 76 is arranged on and/or secured to outer surface 24. In an exemplary embodiment, insulation 76 is arranged at least partially within stud wall 20. In an exemplary embodiment, insulation 76 extends from ground 2 to parapet 16, or top surface 26.

Roof 14 forms the upper covering of the building or structure separating interior 4 and exterior 6. Roof 14 generally comprises at least one layer, for example, layer 30 and layer 40. Layer 30 comprises top surface 32, which faces substantially direction D1 toward exterior 6 and outer surface 34, which faces substantially direction D4 toward exterior 6. In an exemplary embodiment, layer 30 comprises wood (e.g., blocking, stud wall, etc.). In an exemplary embodiment, layer 30 comprises insulation. Layer 30 is connected (e.g., fixedly secured) to stud wall 20. For example, in an exemplary embodiment outer surface 34 is connected to inner surface 22. In an exemplary embodiment, top surface 32 and top surface 26 are aligned. Layer 40 is arranged substantially proximate to or abutting against layer 30. In an exemplary embodiment, layer 40 comprises wood (e.g., blocking, stud wall, etc.). In an exemplary embodiment, layer 40 comprises insulation.

Parapet 16 is a barrier that is an upward extension of wall 12 at the edge of roof 14. Parapet 16 is generally used as a guard rail, to conceal rooftop equipment, to reduce wind loads on roof 14, and to prevent the spread of fires. Parapet 16 extends from wall 12, specifically top surface 26, in direction D1. In an exemplary embodiment, parapet 16 comprises one or more blocks or layers, for example, blocking or layer 50, blocking or layer 60, and blocking or layer 70.

Blocking 60 is arranged on surface 26 and comprises inner surface 62, which faces substantially in direction D3, outer surface 64, which faces substantially in direction D4, top surface 66, which faces substantially in direction D1, and bottom surface 68, which faces substantially in direction D2. In an exemplary embodiment, bottom surface 68 is connected to top surface 26 and at least partially encloses insulation 76. It should be appreciated that insulation 76 may be connected and/or secured to bottom surface 68. In an exemplary embodiment, inner surface 62 is substantially aligned with inner surface 22. In an exemplary embodiment, bottom surface 68 is substantially aligned with top surface 32. In an exemplary embodiment, blocking 60 comprises at least one of wood, metal, and insulation.

Blocking 50 is arranged on blocking 60, specifically surface 66, and comprises inner surface 52, which faces substantially in direction D3, outer surface 54, which faces substantially in direction D4, top surface 56, which faces substantially in direction D1, and bottom surface 58, which faces substantially in direction D2. In an exemplary embodiment, bottom surface 58 is connected to top surface 66. In an exemplary embodiment, inner surface 52 is substantially aligned with inner surface 22 and/or inner surface 62. In an exemplary embodiment, outer surface 54 is substantially aligned with outer surface 64. In an exemplary embodiment, blocking 50 comprises at least one of wood, metal, and insulation.

In an exemplary embodiment, parapet 16 further comprises blocking 70 arranged on blocking 70. Blocking 70 is aligned with outer surface 54 and/or outer surface 64. In an exemplary embodiment, the width of blocking 70 is less than the width of blocking 50, thus creating a stepped parapet 16. In an exemplary embodiment, blocking 70 comprises at least one of wood, metal, and insulation.

Membrane 90 is arranged on and/or connected to one or more outer surfaces of the building or structure. Membrane 90 is arranged on top surface 32 of roof 14. In an exemplary embodiment, membrane 90 is arranged on the outer surface of wall 12, for example, outer surface 54, outer surface 64, and/or outer surface of insulation 76. Membrane 90 is operatively arranged to create a watertight covering to protect interior 4. Membrane 90 also encloses parapet 16. In an exemplary embodiment, membrane 90 is continuous and encloses roof 14 and parapet 16. In an exemplary embodiment, membrane 90 is continuous and encloses roof 14 and parapet 16, and at least partially encloses wall 12. With respect to parapet 16, membrane 90 is arranged on or connected to inner surface 62, inner surface 52, top surface 56, outer surface 54, and outer surface 64. In an exemplary embodiment, membrane 90 further encloses blocking 70. In an exemplary embodiment, membrane 90 comprises rubber, a thermoplastic, or a modified bitumen.

In an exemplary embodiment, roof façade assembly 10 further comprises membrane or membrane patch 91. Membrane 91 is arranged on membrane 90, specifically on base plate 100, to create a watertight covering to protect interior 4. Membrane 91 encloses base plate 100, as will be described below. In an exemplary embodiment, membrane 91 comprises rubber, a thermoplastic, or a modified bitumen.

Framing system 80 is operatively arranged to connect one or more panels to wall 12. Framing system 80 comprises one or more framing members (e.g., wood or metal) connected to wall 12, blocking 50, blocking 60, and/or blocking 70. Framing system 80 includes an inner surface 82, which is secured to wall 12 and/or parapet 16 and faces substantially in direction D3 toward interior 4, and outer surface 84, which faces substantially in direction D4 toward exterior 6. In an exemplary embodiment, and as shown, framing system 80 extends from ground 2 to an elevational level above parapet 16. Such arrangement allows panels to be secured to framing system 80 such that they cover or hide wall 12, parapet 16, and roof 14 from view.

Panel 72 generally comprises wall cladding that adds unique style to the building and creates a seal to protect wall 12 from weather or moisture. Panel 72 is secured to framing system 80 via one or more fasteners 92. In an exemplary embodiment, and as shown, panel 72 extends from ground 2 to an elevational level above parapet 16, and in some cases above the top of framing system 80. Such arrangement allows panel 72 to cover or hide wall 12, parapet 16, and roof 14 from view.

Panel 74 generally comprises wall cladding that adds unique style to the building and creates a seal to protect wall 12, parapet 16, and/or roof 14 from weather or moisture. Panel 74 is secured to parapet 16, via one or more connectors, for example sealing bracket assembly 18, brackets 96, and/or fasteners 94. In an exemplary embodiment, and as shown, panel 74 extends from panel 72 generally in direction D3 to substantially proximate inner surface 52, inner surface 62, and/or outer surface 34. Such arrangement allows panel 74 to cover or hide wall 12, parapet 16, and roof 14 from view. In an exemplary embodiment, panel 74 is arranged at angle $\alpha$ with respect to panel 72. In an exemplary embodiment, angle $\alpha$ is an acute angle (e.g., 3 degrees).

Figure 3:
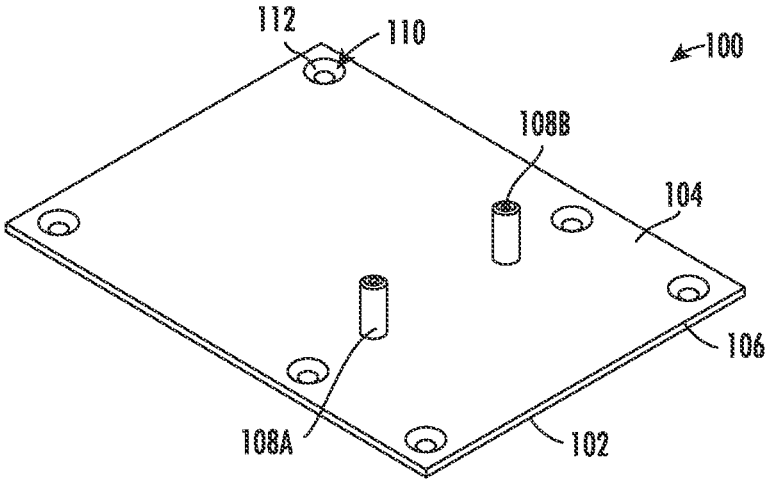
FIG. 3 is a perspective view of the base plate of the sealable bracket assembly shown in FIG. 1.
Figure 4A:
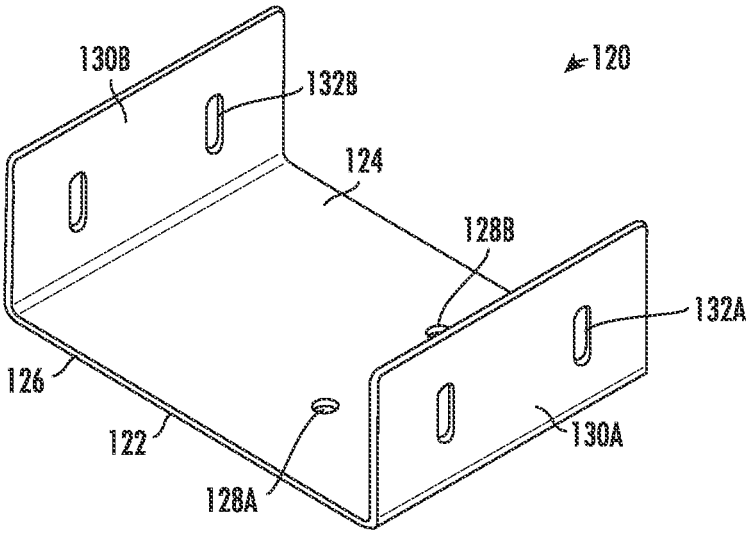
FIG. 4A is a perspective view of the bracket of the sealable bracket assembly shown in FIG. 1.
Figure 4B:
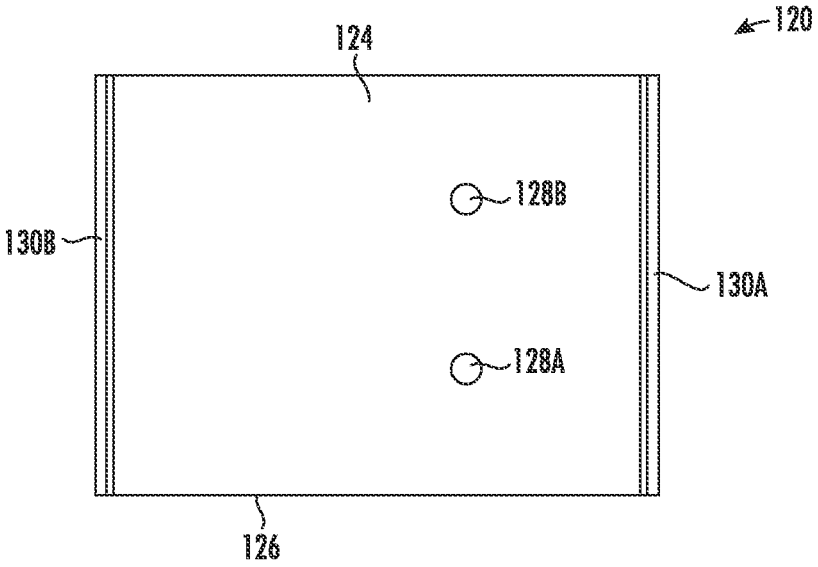
FIG. 4B is a top view of the bracket of the sealable bracket assembly shown in FIG. 1.

Bracket assembly 18 is operatively arranged to connect panel 74 to parapet 16 and/or roof 14 in accordance with building compliance standards. FIG. 3 is a perspective view of base plate 100 of the scalable bracket assembly 18. FIG. 4A is a perspective view of bracket 120. FIG. 4B is a top view of bracket 120.

Base plate 100 comprises bottom surface 102, top surface 104, and perimeter edge 106. Base plate 100 is arranged on top of membrane 90. Specifically, surface 102 is arranged to abut against membrane 90. In an exemplary embodiment, base plate 100 is arranged on top of parapet 16 (i.e., underneath membrane 90). Base plate 100 is secured to blocking 50 via any suitable means. For example, in an exemplary embodiment, base plate 100 comprises one or more through-bores 110 that can be used to secure base plate 100 to surface 56 (e.g., screws, bolts, nails, rivets, etc.). In an exemplary embodiment, one or more through-bores 110 may comprise counter-sink 112. Membrane 91 is arranged to cover base plate 100. Specifically, membrane 91 is arranged on top surface 104 after base plate 100 is secured to parapet 16 over membrane 90. Base plate 100 further comprises one or more protrusions extending from top surface 104 in direction D1, for example, protrusion 108A and protrusion 108B. In an exemplary embodiment, protrusions 108A-108B are bolts or another securement protrusion. Bolts 108A-108B extend through respective holes in membrane 91.

Bracket 120 comprises bottom surface 122, top surface 124, perimeter edge 126, and at least one flange extending from top surface 124, for example, flange 130A and flange 130B. Bracket 120 is arranged on top of membrane 91 and at least partially aligned with base plate 100. Specifically, surface 122 is arranged to abut against membrane 91. Bracket 120 comprises one or more though-bores arranged to align with the bolts of base plate 100. For example, bracket 120 comprises through-bores 128A-128B which align with bolts 108A-108B. Bracket 120 is arranged on membrane 91 such that bolts 108A-108B engage through-bores 128A-128B, and bracket 120 is fastened to base plate 100, for example via nuts 98, such that membrane 91 is squeezed/compressed between top surface 104 and bottom surface 122. This squeezing action prevents the ingress of fluid between membrane 91 and bracket 120 such that it would penetrate the holes in membrane 91 described above.

Flange 130A extends from top surface 124 on a first end of bracket 120 and flange 130A extends from top surface 124 on a second end of bracket 120. In an exemplary embodiment, flanges 130A and 130B are arranged on opposite sides of bracket 120. Flanges 130A-130B provide the vertical structure for mounting panel 74. In an exemplary embodiment, at least one of flanges 130A and 130B are arranged perpendicular to top surface 124. In an exemplary embodiment, the length of flange 130A is less than the length of flange 130B. In an exemplary embodiment, flange 130A comprises at least one through-hole 132A and/or flange 130B comprises at least one through-hole 134B. Brackets 96 may be connected to flanges 130A-130B via through-holes 132A-132B and connectors (e.g., bolts, screws, nails, rivets, dowels, etc.); although it should be appreciated that other forms of connection may be used, for example, adhesive, welding, soldering, and the like. In an exemplary embodiment, brackets 96 comprise a first member and a second member arranged at angle β with respect to the first member. In an exemplary embodiment, angle β is greater than 0 degrees and less than 10 degrees, for example 2 degrees. Panel 74 may be connected to brackets 96 via fasteners 94. It should be appreciated that in some embodiments, panel 74 is connected directly to flanges 130A-130B.

Figure 5:
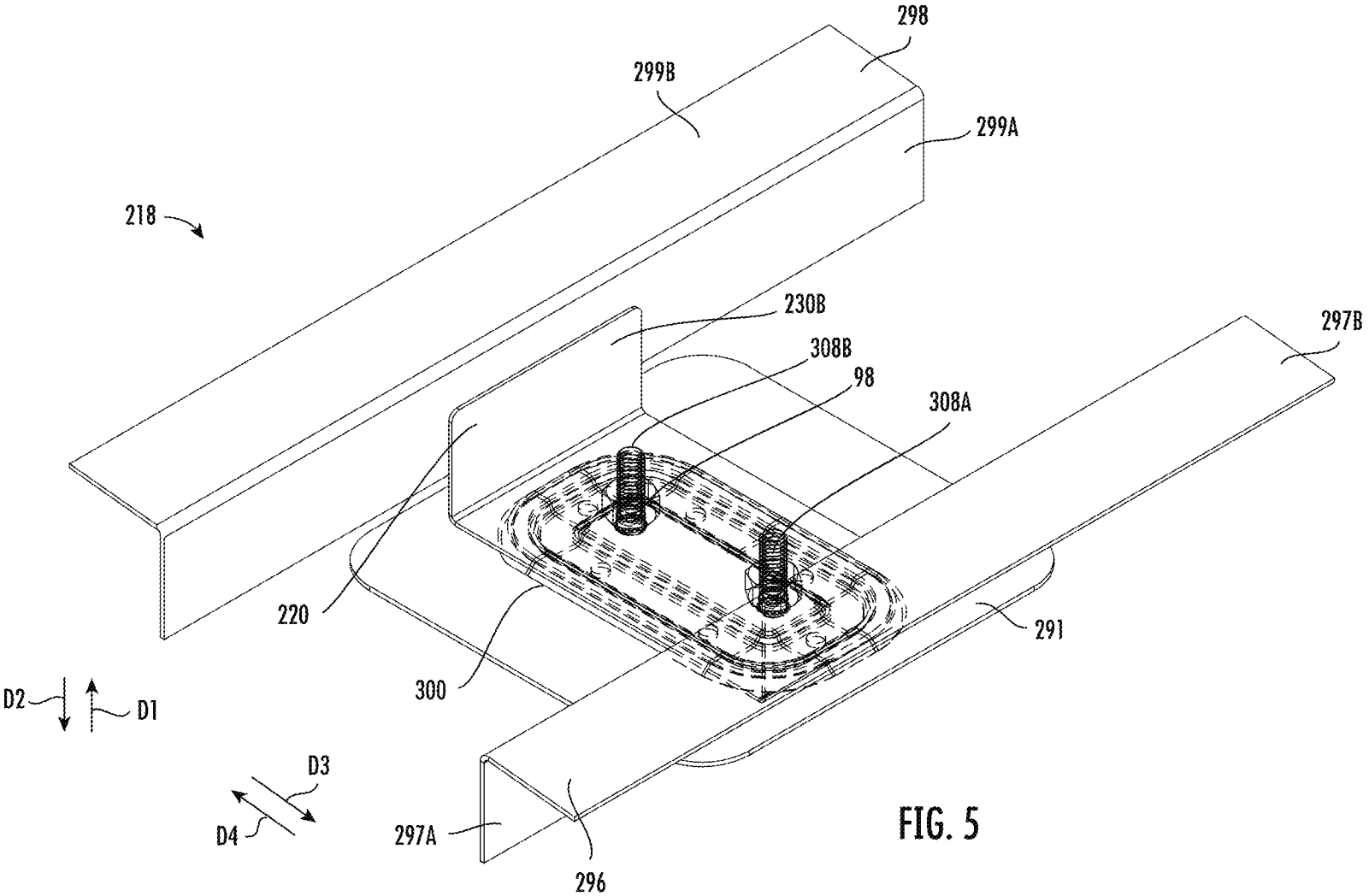
FIG. 5 is a perspective view of a sealable bracket assembly.
Figure 6:
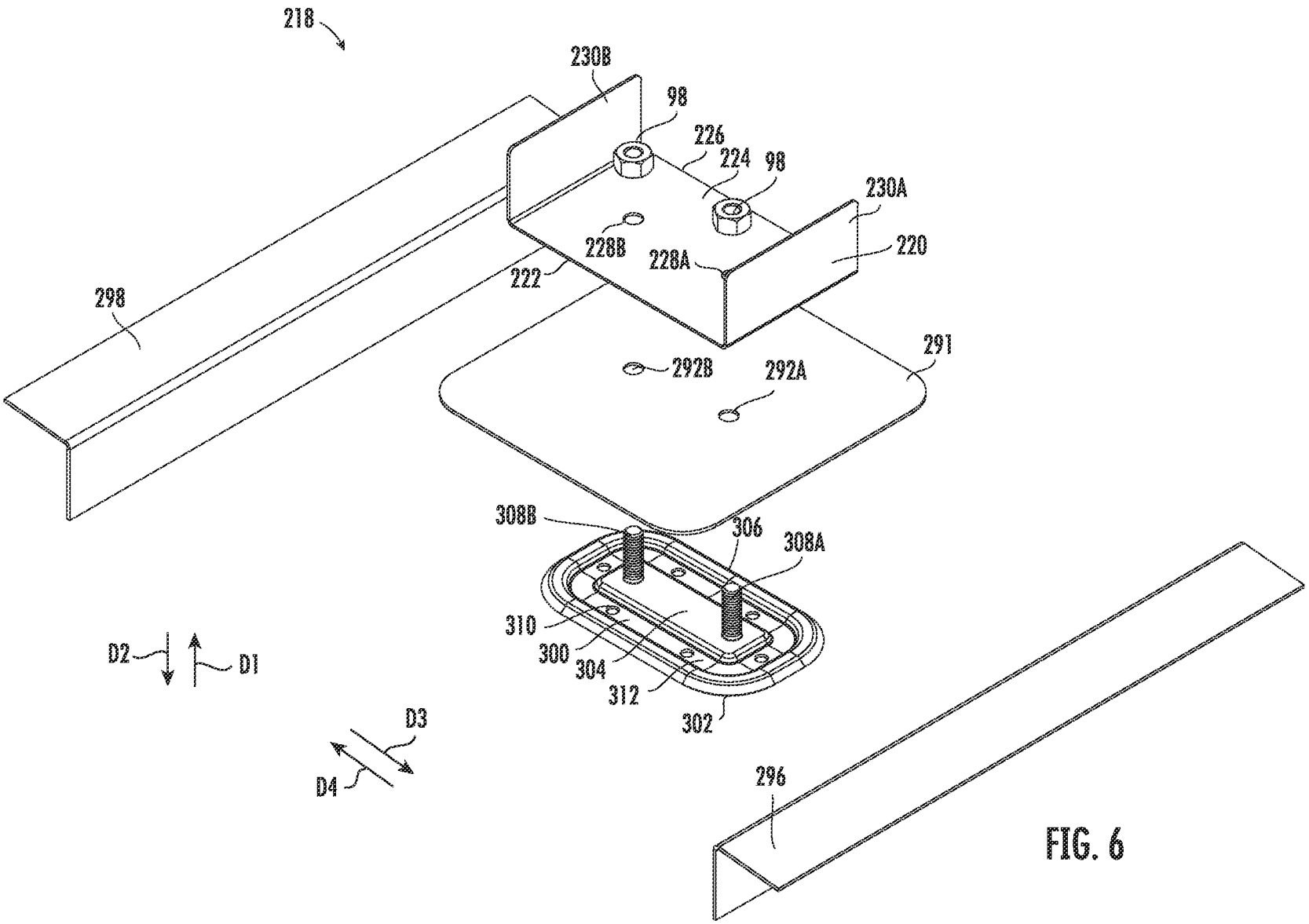
FIG. 6 is an exploded perspective view of the sealable bracket assembly shown in FIG. 5.

FIG. 5 is a perspective view of scalable bracket assembly 218. FIG. 6 is an exploded perspective view of scalable bracket assembly 218. Scalable bracket assembly 218 may be used instead of or in conjunction with scalable bracket assembly 18 to connect panel 74 to parapet 16 and/or roof 14, in accordance with building compliance standards. For example, panel 74 is secured to parapet 16, via one or more connectors, for example sealing bracket assembly 218, brackets 296 and 298, and/or fasteners 94. Scalable bracket assembly 218 generally comprises membrane or membrane patch 291, base plate 300, and bracket 220. In an exemplary embodiment, scalable bracket assembly 218 further comprises at least one of bracket 296 and bracket 298.

Membrane 291 is arranged on membrane 90, specifically on base plate 300, to create a watertight covering to protect interior 4. Membrane 291 encloses base plate 300, as will be described below. In an exemplary embodiment, membrane 291 comprises rubber, a thermoplastic, or a modified bitumen.

Figure 7:
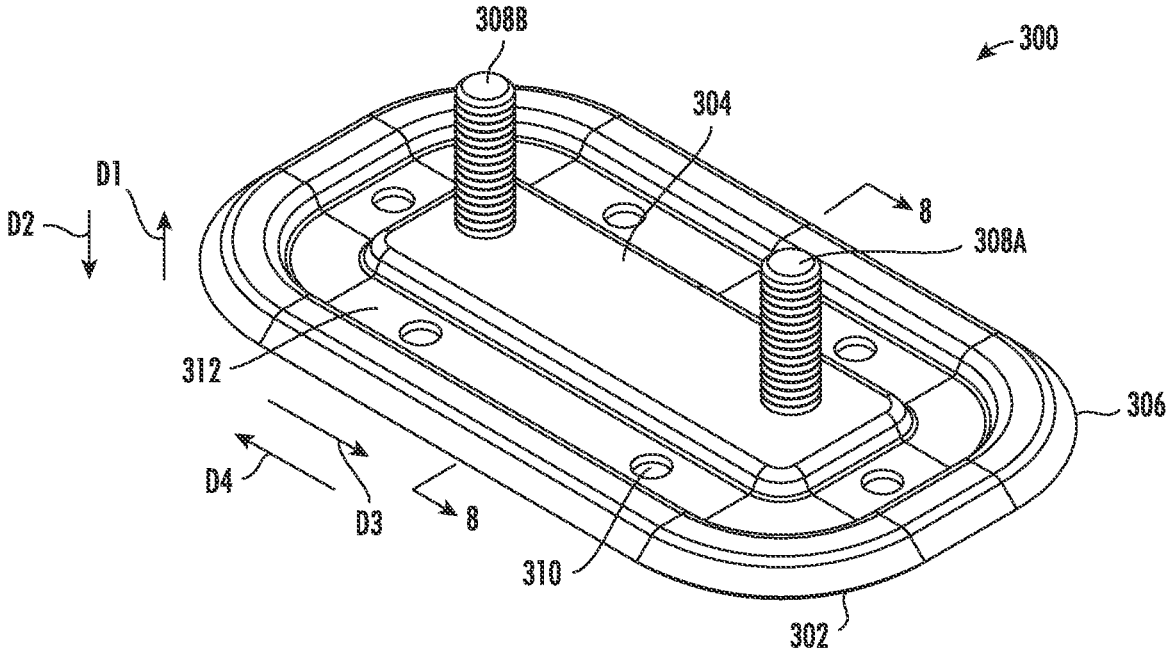
FIG. 7 is a perspective view of the base plate of the sealable bracket assembly shown in FIG. 5.
Figure 8:
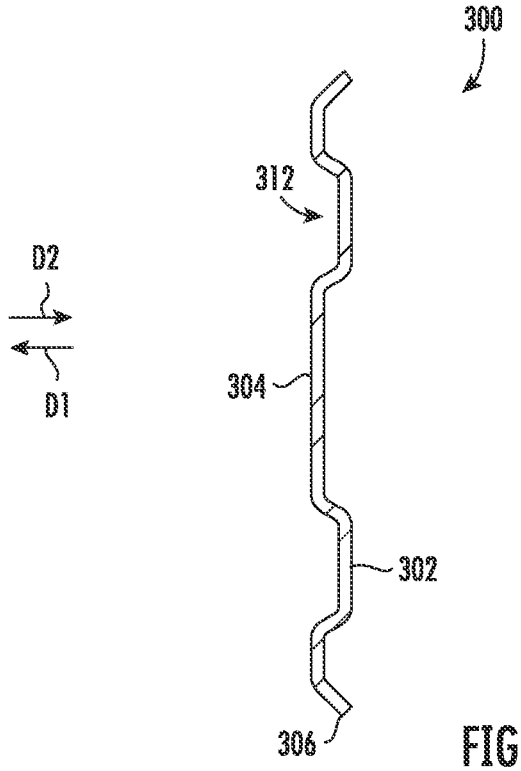
FIG. 8 is a cross-sectional view of the base plate taken generally along line 8-8 in FIG. 7.

FIG. 7 is a perspective view of base plate 300. FIG. 8 is a cross-sectional view of base plate 300. Base plate 300 comprises bottom surface 302, top surface 304, and perimeter edge 306. Base plate 300 is arranged on top of membrane 90. Specifically, surface 302 is arranged to abut against membrane 90. In an exemplary embodiment, base plate 300 is arranged on top of parapet 16 (i.e., underneath membrane 90). Base plate 300 is secured to blocking 50 via any suitable means. For example, in an exemplary embodiment, base plate 300 comprises one or more through-bores 310 that can be used to secure base plate 300 to surface 56 (e.g., screws, bolts, nails, rivets, etc.). In an exemplary embodiment, one or more through-bores 310 are arranged in groove or recess 312, which allows the connectors (e.g., screws, bolts, nails, rivets, etc.) to secure base plate 300 to parapet 16 and/or roof 14 and not protrude past surface 304 in direction D1 (i.e., the screws are aligned with or set in from surface 304). In an exemplary embodiment, surface 304 is curvilinear along perimeter edge 306 such that base plate 300 decreases in thickness in a radially outward direction. The curvilinear nature of base plate 300 and/or the recessed connector arrangement allows for membrane 291 to create an optimal seal thereover.

Membrane 291 is arranged to cover base plate 300. Specifically, membrane 291 is arranged on top surface 304 after base plate 300 is secured to parapet 16 over membrane 90. Base plate 300 further comprises one or more protrusions extending from top surface 304 in direction D1, for example, protrusion 308A and protrusion 308B. In an exemplary embodiment, protrusions 308A-308B are bolts or another securement protrusion. Bolts 308A-308B extend through holes 292A-292B in membrane 291.

Bracket 220 comprises bottom surface 222, top surface 224, perimeter edge 226, and at least one flange extending from top surface 224, for example, flange 230A and flange 230B. Bracket 220 is arranged on top of membrane 291 and at least partially aligned with base plate 300. Specifically, surface 222 is arranged to abut against membrane 291. Bracket 220 comprises one or more though-bores arranged to align with the bolts of base plate 300. For example, bracket 220 comprises through-bores 228A-228B which align with bolts 308A-308B. Bracket 220 is arranged on membrane 291 such that bolts 308A-308B engage through-bores 228A-228B, and bracket 220 is fastened to base plate 300, for example via nuts 98, such that membrane 291 is squeezed/compressed between top surface 304 and bottom surface 222. This squeezing action prevents the ingress of fluid between membrane 291 and bracket 220 such that it would penetrate holes 292A-292B in membrane 291.

Flange 230A extends from top surface 224 on a first end of bracket 220 and flange 230A extends from top surface 224 on a second end of bracket 220. In an exemplary embodiment, flanges 230A and 230B are arranged on opposite sides of bracket 220. Flanges 230A-230B provide the vertical structure for mounting panel 74. In an exemplary embodiment, at least one of flanges 230A and 230B are arranged perpendicular to top surface 224. In an exemplary embodiment, the length of flange 230A is less than the length of flange 230B. In an exemplary embodiment, flange 230A comprises at least one through-hole and/or flange 230B comprises at least one through-hole. Brackets 296 and 298 may be connected to flanges 230A and 230B, respectively, via any suitable connection means including, for example, bolts, screws, nails, rivets, dowels, adhesive, welding, soldering, and the like. In an exemplary embodiment, panel 74 may be connected to brackets 296 and 298. In an exemplary embodiment, panel 74 is connected directly to flanges 230A-230B.

Figure 9:
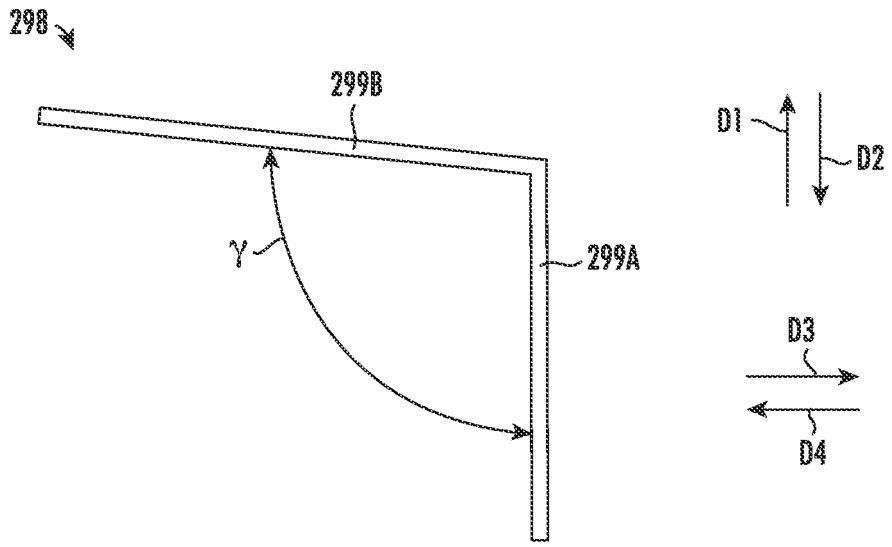
FIG. 9 is a side elevational view of the bracket of the sealable bracket assembly shown in FIG. 5.

FIG. 9 is a side elevational view of bracket 298. Bracket 298 comprises plate 299A and plate 299B. Plate 299A is operatively arranged to be connected to flange 230B, as described above. Thus, when assembled, in an exemplary embodiment plate 299A is arranged perpendicular to top surface 224. Panel 74 is operatively arranged to be connected to plate 299B via any suitable connection means, as described above. Plate 299B is arranged at angle γ with respect to plate 299A. In an exemplary embodiment, angle γ is an obtuse angle. In an exemplary embodiment, angle γ is between 92° and 100°, preferably 96°. In an exemplary embodiment, when assembled, panel 74 will slop downward in direction D3.

Figure 10:
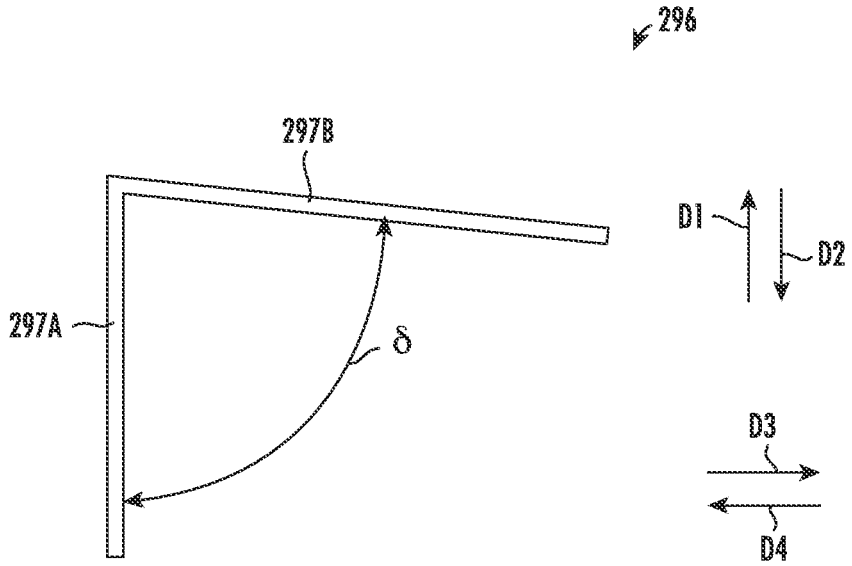
FIG. 10 is a side elevational view of the bracket of the sealable bracket assembly shown in FIG. 5.

FIG. 10 is a side elevational view of bracket 296. Bracket 296 comprises plate 297A and plate 297B. Plate 297A is operatively arranged to be connected to flange 230A, as described above. Thus, when assembled, in an exemplary embodiment plate 297A is arranged perpendicular to top surface 224. Panel 74 is operatively arranged to be connected to plate 297B via any suitable connection means, as described above. Plate 297B is arranged at angle δ with respect to plate 297A. In an exemplary embodiment, angle δ is an acute angle. In an exemplary embodiment, angle δ is between 80° and 89°, preferably 84°. In an exemplary embodiment, when assembled, panel 74 will slop downward in direction D3.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

2 Ground or base
4 Interior of structure or building
6 Exterior of structure or building
10 Roof façade assembly
12 Structure or building wall
14 Structure or building roof
16 Structure or building parapet
18 Sealable bracket assembly
20 Stud wall
22 Inner surface
24 Outer surface
26 Top surface
28 Bottom surface
30 Blocking or layer
32 Top surface
34 Bottom-Outer surface
40 Blocking or layer
50 Blocking or layer
52 Inner surface
54 Outer surface
56 Top surface
58 Bottom surface
60 Blocking or layer
62 Inner surface
64 Outer surface
66 Top surface
68 Bottom surface
70 Blocking or layer
72 Panel or façade
74 Panel or façade
76 Insulation
80 Framing system
82 Inner surface
84 Outer surface
90 Membrane
91 Membrane
92 Fastener
94 Fastener
96 Brackets
98 Nuts
100 Base plate
102 Bottom surface
104 Top surface
106 Perimeter edge
108A Bolt or protrusion
108B Bolt or protrusion
110 Through-bores
112 Countersinks
120 Bracket
122 Bottom surface
124 Top surface
126 Perimeter edge
128A Through-bore
128B Through-bore
130A Flange
130B Flange
132A Through-hole(s)
132B Through-hole(s)
218 Sealable bracket assembly
220 Bracket
222 Bottom surface
224 Top surface
226 Perimeter edge
228A Through-bore
228B Through-bore
230A Flange
230B Flange
291 Membrane
292A Hole
292B Hole
296 Bracket
297A Plate
297B Plate
298 Bracket
299A Plate
299B Plate
300 Base plate
302 Bottom surface
304 Top surface
306 Perimeter edge
308A Bolt or protrusion
308B Bolt or protrusion
310 Through-bores
312 Groove
D1 Direction
D2 Direction
D3 Direction
D4 Direction
α Angle
β Angle
γ Angle
δ Angle

What is claimed is:

1. A roof assembly, comprising:
a roof including a first top surface facing a first direction and an outer surface;
a first membrane arranged on the first top surface;
a base plate arranged on the first membrane and connected to the roof;
a second membrane arranged on the base plate;
a bracket arranged on the second membrane and at least partially aligned with the base plate, wherein the bracket is secured to the base plate and includes:
a bracket plate abutting against the second membrane; and
a first flange extending from the bracket plate in the first direction; and
a second flange extending from the bracket plate in the first direction, the second flange spaced apart from the first flange;
a first support plate connected to the first flange at an obtuse angle; and
a second support plate connected to the second flange at an acute angle.

2. The roof assembly as recited in claim 1, wherein:
the roof further comprises a parapet extending in the first direction from the roof proximate the outer surface; and
the base plate is arranged on the parapet.

3. The roof assembly as recited in claim 2, further comprising a wall connected to the roof and the parapet.

4. The roof assembly as recited in claim 3, further comprising:
a first panel connected to the wall; and
a second panel connected to the bracket and arranged to at least partially cover the parapet, the first panel extending from the second panel to a ground surface.

5. The roof assembly as recited in claim 4, wherein the first panel extends elevationally above the parapet.

6. The roof assembly as recited in claim 4, wherein the second panel is arranged elevationally above and spaced apart from the roof.

7. The roof assembly as recited in claim 4, wherein the second panel is arranged at an acute angle with respect to the first panel.

8. The roof assembly as recited in claim 2, wherein the parapet comprises a stepped top surface.

9. The roof assembly as recited in claim 1, wherein the base plate comprises a second top surface, a bottom surface secured to the roof, and at least one protrusion extending from the second top surface.

10. The roof assembly as recited in claim 9, wherein the at least one protrusion extends through the second membrane.

11. The roof assembly as recited in claim 10, wherein the bracket comprises a through-bore arranged to engage the at least one protrusion to secure the bracket to the base plate.

12. The roof assembly as recited in claim 1, wherein the second membrane is compressed between the bracket and the base plate.

13. The roof assembly as recited in claim 1, wherein a panel is connected to at least one of the first flange and the second flange, the panel arranged to at least partially cover the roof.

14. A roof assembly, comprising:

a roof including a first top surface and an outer surface;

a parapet extending in a first direction from the roof proximate the outer surface;

a first membrane covering the first top surface and the parapet;

a base plate arranged on the first membrane and connected to the parapet;

a bracket including at least one flange extending in the first direction, the bracket secured to the base plate;

a second membrane arranged between the base plate and the bracket;

a first panel connected to the at least one flange and arranged to at least partially cover the parapet; and a second panel connected to the parapet, the second panel extending in a second direction, opposite the first direction, from the first panel to a ground surface.

15. The roof assembly as recited in claim 14, wherein the base plate comprises:

a second top surface;

a bottom surface secured to the parapet; and at least one protrusion extending from the second top surface in the first direction.

16. The roof assembly as recited in claim 15, wherein the at least one protrusion extends through the second membrane.

17. The roof assembly as recited in claim 16, wherein the bracket comprises a through-bore arranged to engage the at least one protrusion to secure the bracket to the base plate.

18. The roof assembly as recited in claim 14, wherein the first panel is fixedly secured to the bracket via one or more fasteners.

19. A wall assembly, comprising:

a roof including a first top surface and an outer surface;

a wall extending from a ground surface to the roof;

a parapet extending in a first direction from the roof proximate the outer surface;

a first membrane covering the first top surface and the parapet;

a base plate arranged on the first membrane and connected to the parapet;

a threaded rod fixedly secured to the base plate and extending in the first direction therefrom;

a bracket secured to the base plate via the threaded rod and including:

a bracket plate abutting against the second membrane; and a flange extending from the bracket plate in the first direction;

a second membrane arranged between the base plate and the bracket;

a support plate connected and arranged non-perpendicular to the flange; and a wall panel connected to the wall and the support plate, the wall panel arranged to cover the wall and wrap around the roof to at least partially cover the parapet.

* * * * *